US007132045B1

(12) United States Patent
Trangsrud

(10) Patent No.: US 7,132,045 B1
(45) Date of Patent: Nov. 7, 2006

(54) SANITARY, STORM AND CATCH BASIN TRAP WITH FILTER INSERT

(75) Inventor: Julian P. Trangsrud, Northfield, MN (US)

(73) Assignee: Trangsrud & Associates, Inc., Northfield, MN (US)

( * ) Notice: Subject to any disclaimer, the term of this patent is extended or adjusted under 35 U.S.C. 154(b) by 68 days.

(21) Appl. No.: 10/960,582

(22) Filed: Oct. 7, 2004

(51) Int. Cl.
*E03F 5/06* (2006.01)

(52) U.S. Cl. ..... 210/163; 210/166; 210/474; 404/4

(58) Field of Classification Search ..... 210/163, 210/164, 166, 170, 474; 404/4, 5
See application file for complete search history.

(56) References Cited

U.S. PATENT DOCUMENTS 1,041,887 A * 10/1912 Schodde ..... 210/163
5,232,587 A * 8/1993 Hegemier et al. ..... 404/4
5,284,580 A * 2/1994 Shyh ..... 210/164
5,486,287 A * 1/1996 Murphy et al. ..... 210/164
5,985,157 A * 11/1999 Leckner et al. ..... 210/163
6,149,803 A 11/2000 DiLoreto, Jr. et al. ..... 210/164
6,214,216 B1 * 4/2001 Isaacson ..... 210/164
6,270,663 B1 * 8/2001 Happel ..... 210/163
6,368,499 B1 4/2002 Sharpless ..... 210/164
6,793,811 B1 * 9/2004 Fleischmann ..... 210/163
2002/0048490 A1 * 4/2002 Allard et al. ..... 210/170

* cited by examiner

*Primary Examiner*—Christopher Upton
(74) *Attorney, Agent, or Firm*—Nikolai & Mersereau, P.A.

(57) ABSTRACT

A temporary trap having baskets and optionally filters in the baskets used in conjunction with curb inlets for sewer systems to keep debris from being washed into the sewer during construction of roads and sewers. The trap is a box, typically rectangular, square or round, with baskets having a plurality of holes therein for allowing water to pass therethrough while trapping debris therein. The trap is inserted into a curb inlet by lifting the grate off the curb inlet frame, inserting the trap and then replacing the grating. After a rain the baskets and filters may be cleaned out and reused. Optionally, when the construction project is finished the grate is lifted off the curb inlet frame and the trap removed. An optional cloth filter for insertion into the trap filters finer debris from entering the sewer system. The trap has an overflow opening in case the trap becomes clogged.

12 Claims, 6 Drawing Sheets

SANITARY, STORM AND CATCH BASIN TRAP WITH FILTER INSERT

BACKGROUND OF THE INVENTION

1. Field of the Invention

This invention relates to traps and filters for insertion under a curb inlet grating for a sanitary, storm or catch basin.

2. Description of the Related Art

When streets are under construction the catch basins for the sewers can fill up with all kinds of debris during rains. Since the construction of the area is not complete there are many objects in the area that can be washed into the newly installed sewer and clog it up, whereas after construction the area is in finished condition, landscaped, fully paved, and construction related debris is removed therefore presenting fewer objects which can be washed into the catch basin and clog up the sewer.

SUMMARY OF THE INVENTION

An insert for the curb inlet frame is installed to catch debris and preventing sewers from being clogged during construction projects. The insert can then be removed if no longer needed.

The insert has the same shape and size as the curb inlet frame such that it fits inside and conforms to the road grade and curb cuts as does the curb inlet frame. A grate fits over the insert and holds it in place within the curb inlet frame. The insert has a frame for holding baskets with plurality of holes to let water through and catch debris by preventing the debris from passing through the holes. The insert has an overflow for letting water pass into the sewer, if the holes in the baskets are blocked by debris or the water flow into the insert is higher than the restricted flow out due to the holes in the basket being blocked. The basket can be easily removed from the inset to remove debris caught therein. A filter made out of a cloth can be placed in the baskets to catch smaller debris. The filter can be easily removed by hand and cleaned or replaced by another filter while the insert and or the basket remains in place.

OBJECTS OF THE INVENTION

It is an object of the invention to provide a temporary filter box for insertion into a curb box to capture debris preventing it from clogging a storm sewer.

It is an object of the invention to provide a filter insert for the filter box to capture smaller particles and debris from clogging a storm sewer.

It is an object of the invention to match the temporary filter box to the shape of the permanent curb box and grate for efficient operation.

It is an object of the invention to provide a basket for capturing large debris and for easily removing the basket for cleaning it out by hand.

Other objects, advantages and novel features of the present invention will become apparent from the following description of the preferred embodiments when considered in conjunction with the accompanying drawings.

DESCRIPTION OF THE PREFERRED EMBODIMENTS

During street construction and at other times there is an added need for traps and filters to remove debris from the water flow from the street into storm drains. The larger pieces of debris can clog up sewer systems, which then need to be cleaned out. It is preferred to have a trap for catching the larger pieces of debris and optionally a filter for catching smaller objects. Debris can be expected in larger quantities during construction of a road, during some maintenance projects or at other times when more than the normal amount of debris is present in the area which can be washed into storm drains during rains.

Figure 1:
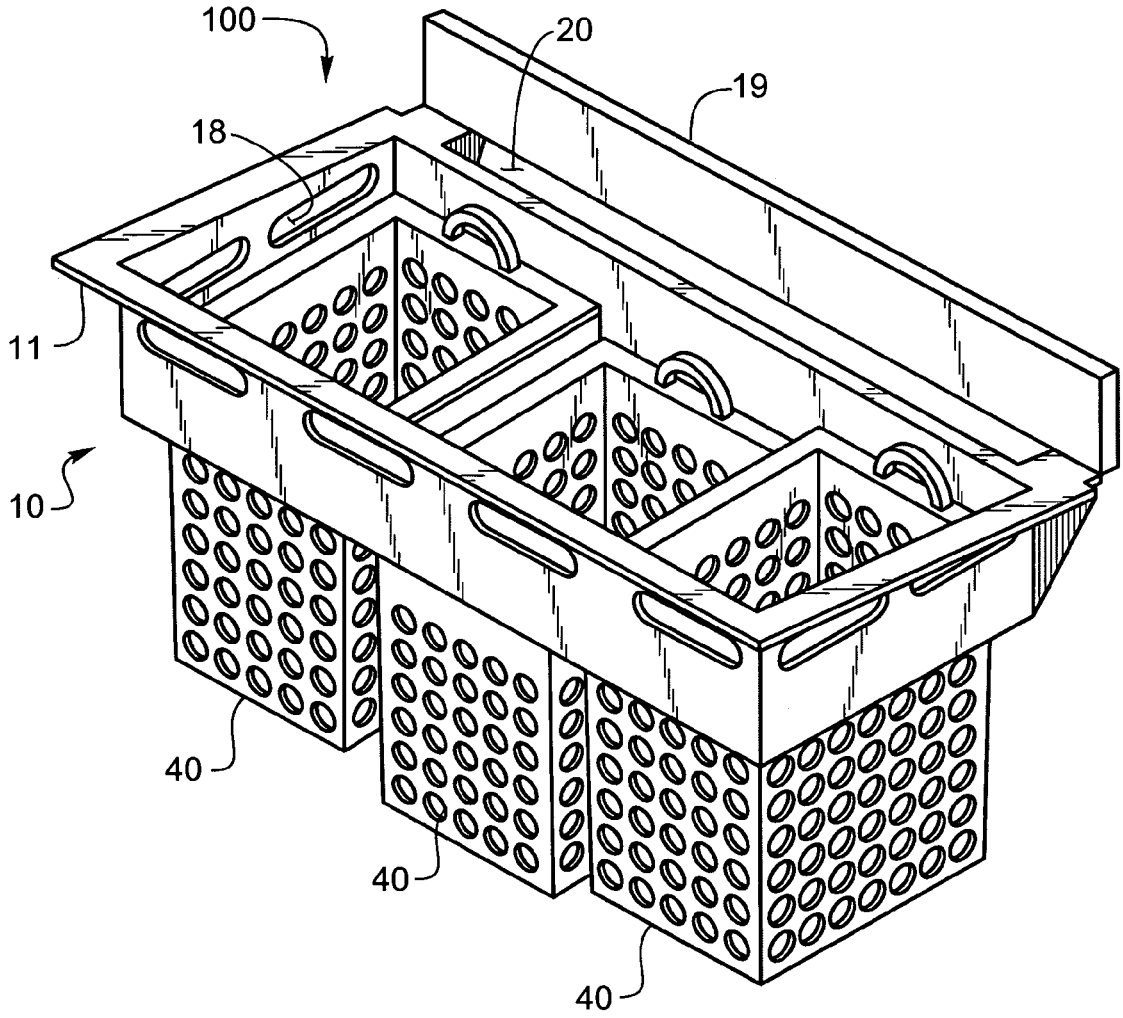
FIG. 1 is a front view of a filter box frame with baskets installed.
Figure 5:
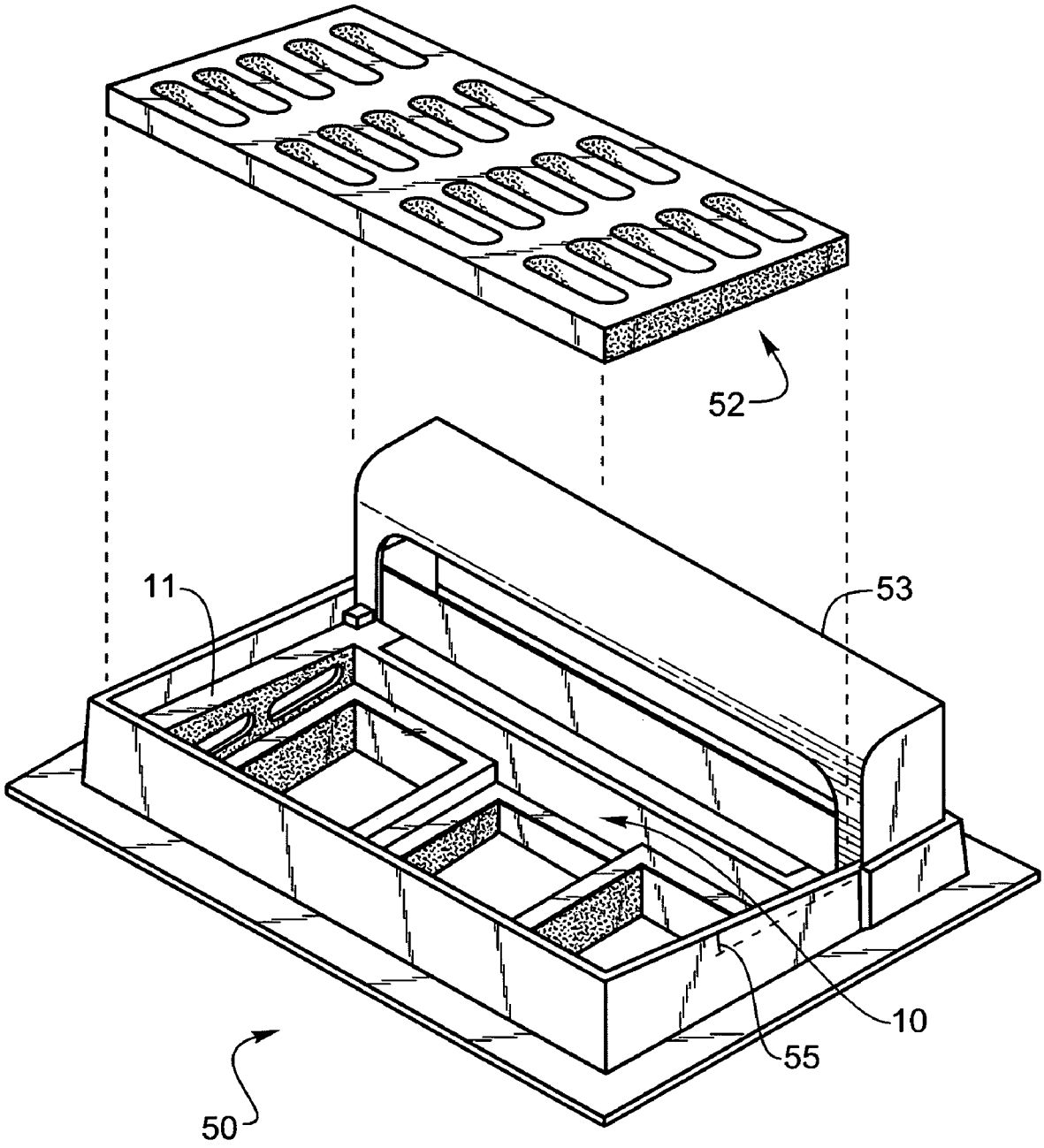
FIG. 5 is a perspective view of a curb inlet frame with a curb inlet box installed.

When extra debris is present a temporary trap 100, as seen in FIG. 1, can be added to a curb inlet 50 as shown in FIG. 5. The temporary trap 100 has trap insert frame 10 with a flange 11 around its perimeter to engage the curb inlet frame flange 59 (see FIG. 5) so as to secure trap insert frame 10 therein. Grate 52 is then placed on top of flange 11 to hold the temporary trap 100 in place.

The temporary trap 100 has a trap insert frame 10, a center basket 40, and two end baskets 40 having apertures 42 on the front walls 46, rear wall 45, right side walls 47, left side walls 48, and bottoms 49. The apertures 42 allow water to pass though but block larger pieces of debris from passing therethrough.

Figure 2:
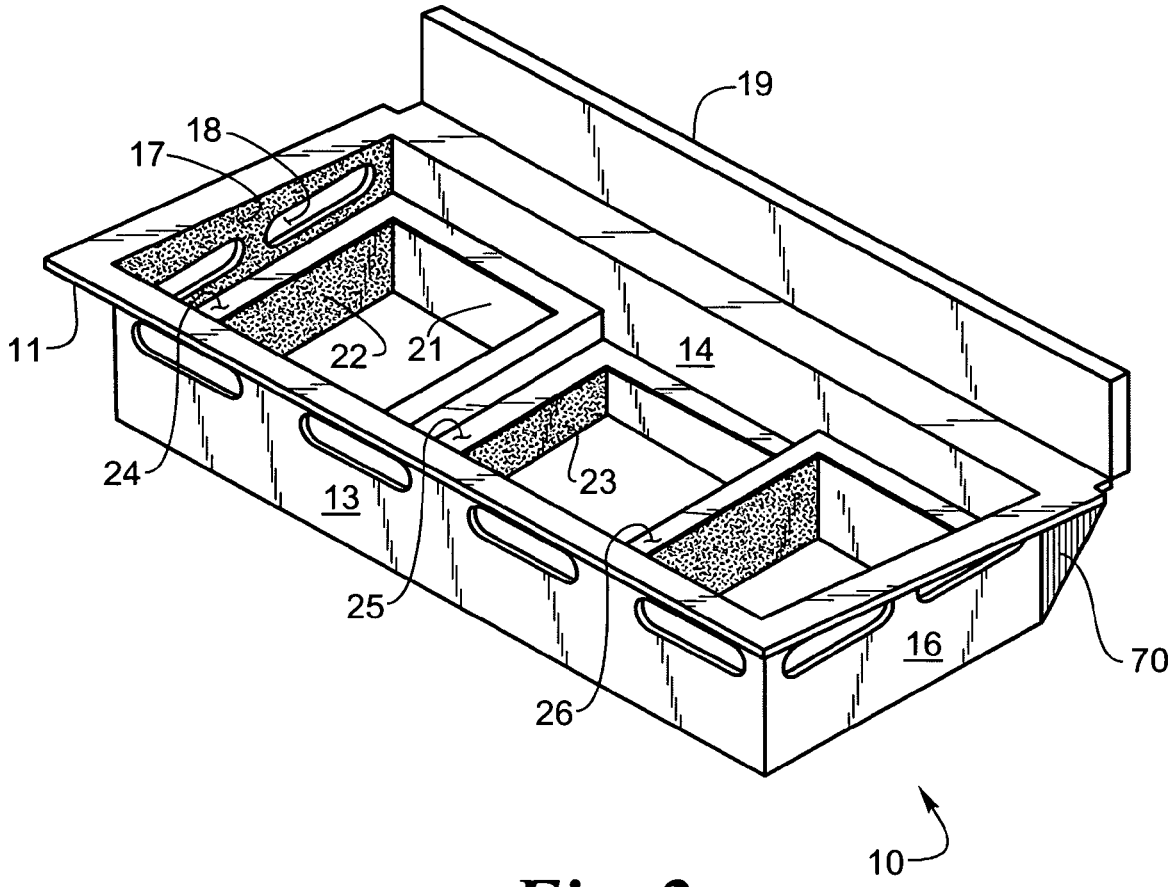
FIG. 2 is a front perspective view of the filter box frame.
Figure 3:
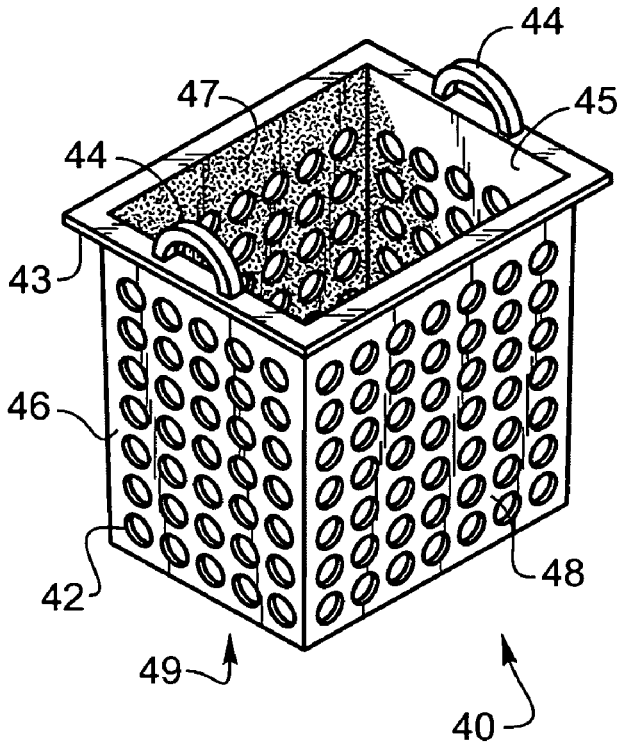
FIG. 3 is a perspective view of the basket for the filter box.

As shown in FIG. 2 there are overflow openings 18 at the top of each end wall 16, 17 and in the front wall 13 in the trap insert frame 10 to allow large flows of water through when the apertures 42 in the baskets 40 do not allow sufficient flow therethrough during heavy rains or for allowing water through as the apertures 42 in baskets 40 get blocked by debris.

The walls 16 and 17 have a slope along the top sloping downward from the front wall 13 to the back wall 14 to match the slope of the sloped curb inlet frame wall 55. The curb inlet frame 50 has such a sloped wall to match the slope of the street 57 near the curb 56 to channel water off the street 57 into the curb inlet 50. The design as shown in the figures having a lower center basket 40 allows for the center basket 40 to fill first and the end baskets 40 to fill last with the overflow passing through overflow openings 18. In alternative embodiments the slope of the walls 16 and 17 may be different.

The trap insert frame 10 has a curb box blocker 19 for blocking water flows though the curb box 53 so that the water flow can pass though the apertures 42 in the baskets 40. Alternatively the curb box blocker 19 may have aperture 20 at its base to allow for excess water to flow therethrough. In some embodiments there is no curb box 53 so no curb box blocker 19 is required on trap insert frame 10.

The trap insert frame 10 has frame flanges 24, 25, 26 for supporting center basket and end baskets 40. The flange 43 on center basket 40 engages flange 25, the flange 43 on the left basket engages flange 24 on the trap insert frame 10 and flange 26 engages flange 43 on the right end basket 40. Handles 44 on baskets 40 allow the baskets to be quickly and easily removed from the trap insert frame 10 for cleaning out the baskets 40 and then replacing the baskets. To clean out the baskets first the grate 52 is removed and then the baskets 40 can be removed. If silt filters 30 have been installed in the baskets 40 the silt filters 30 can be removed and cleaned.

In the embodiment shown in the figures the center basket 40 is held by flange frame 25, which is lower than flange frames 24 and 26. This positions center basket 40 lower than the left or right baskets 40 and allows water to flow into the center basket 40 and fill it first and then fills the end baskets 40. The center basket 40 has the base lower than the other baskets allowing extra flow out of the apertures 42 at the base on the sides adjacent the left and right baskets for extra drainage from the center basket 40.

In an alternative embodiment the trap insert frame 10 and the baskets 40 have uniformly the same height flanges 24, 25, 26 so the baskets 40 are all at the same height.

Figure 4:
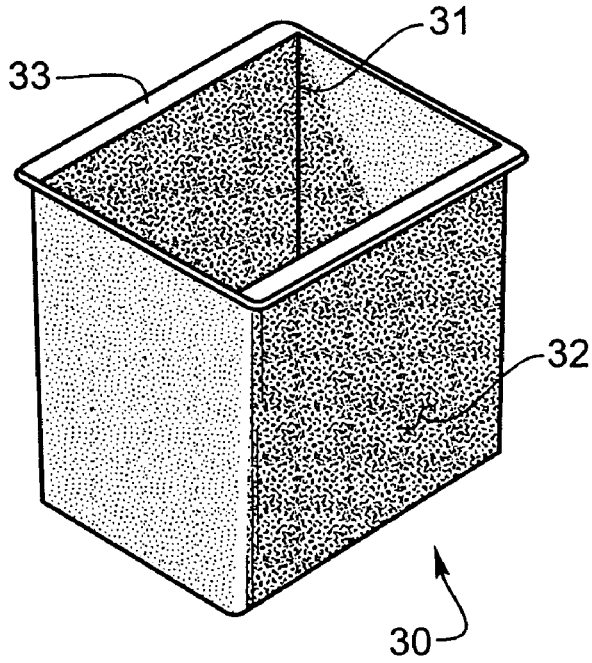
FIG. 4 is a rear perspective view of the filter for the filter box.

A silt filter 30 having a wire frame 31 in the shape of the baskets 40 with a cloth covering 32, as shown in FIG. 4, can be used to filter out small items, which can fit though apertures 42 but not though the weave of the cloth 32. The filters 30 sit in the baskets 40 and can be easily removed and cleaned or replaced. Flanges 33 on the wire frame 31 are used to support the filter 30 on top of the baskets 40.

Figure 6:
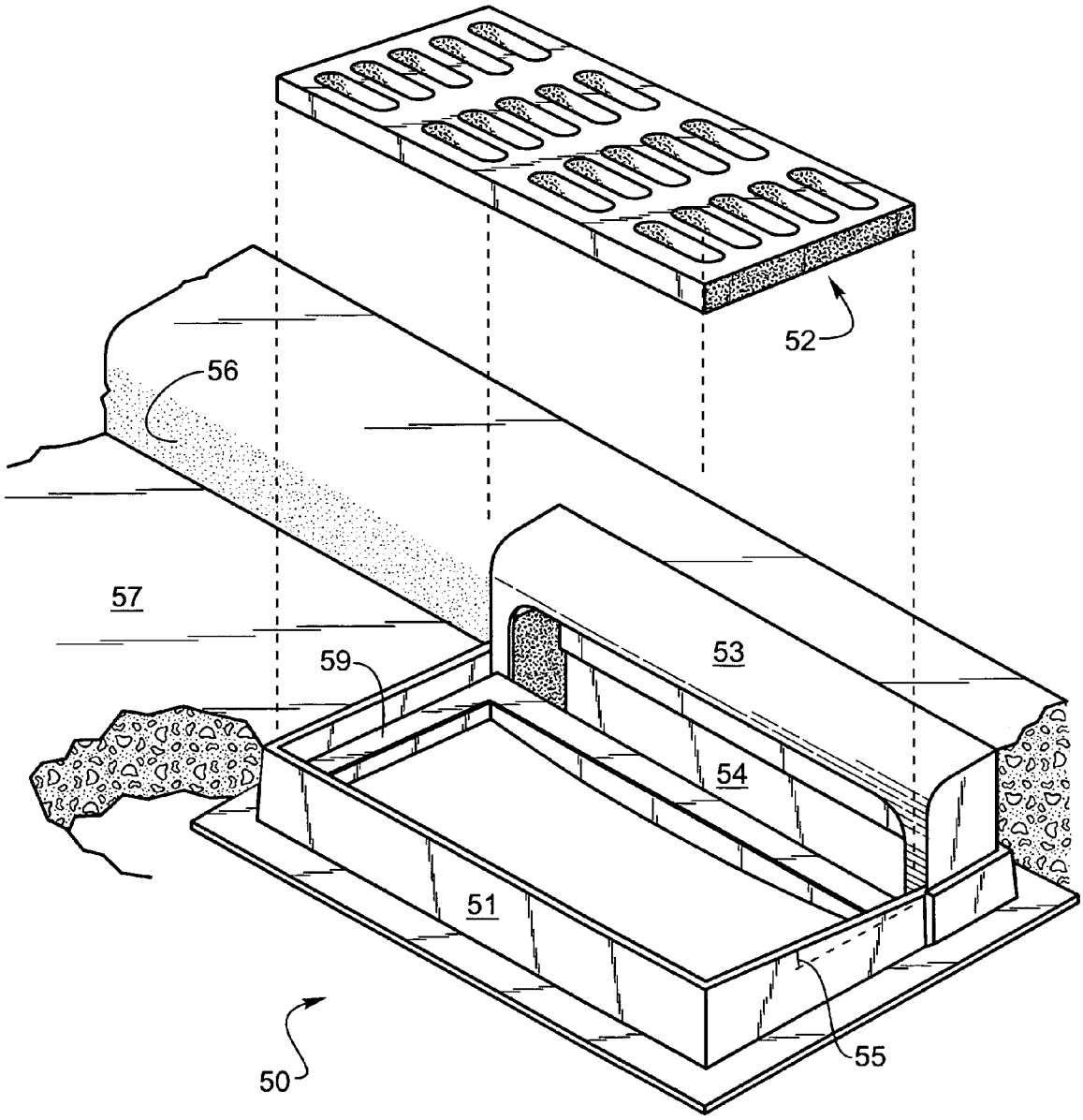
FIG. 6 is a perspective view of a curb inlet frame, grate and curb box.

As shown in FIG. 6 a curb inlet 50 has a curb inlet frame 51 with a grate 52 thereon. An optional curb box 53 allows water to enter curb inlet 54 along the curb wall 56 when water carrying debris is running down the street 57.

As shown in FIG. 6 the grate 52 is lifted out of the curb inlet frame 51 and filter box 10 can then be dropped into the curb inlet frame. The grate 52 can then be placed on top of the flange 11 of the filter box to hold the filter box in place. When it is desired to remove the temporary trap 100 the grate 52 is removed and the filter box 100 lifted out of the curb inlet frame. In this manner the temporary trap 100 may be temporarily added to the curb inlet 50 to prevent debris from entering the sewer. The grate 52 can be lifted and the debris removed after each rainstorm, or when the baskets 40 become clogged. Alternatively a silt filter 30 can be inserted into the baskets 40 to trap smaller pieces of debris by removing the grate 52.

Figure 7:
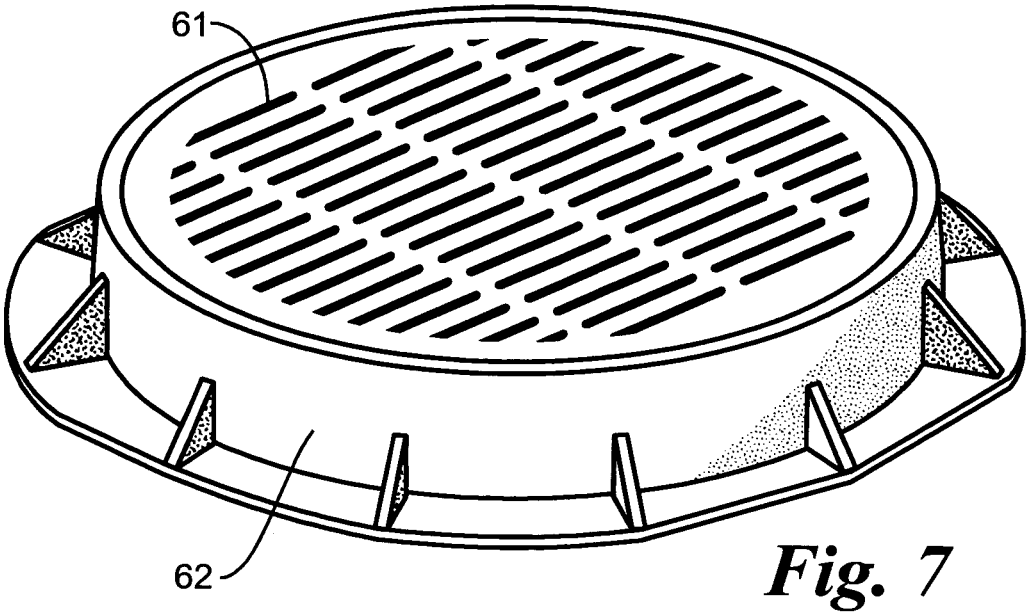
FIG. 7 is a perspective view of a manhole frame and grate.
Figure 8:
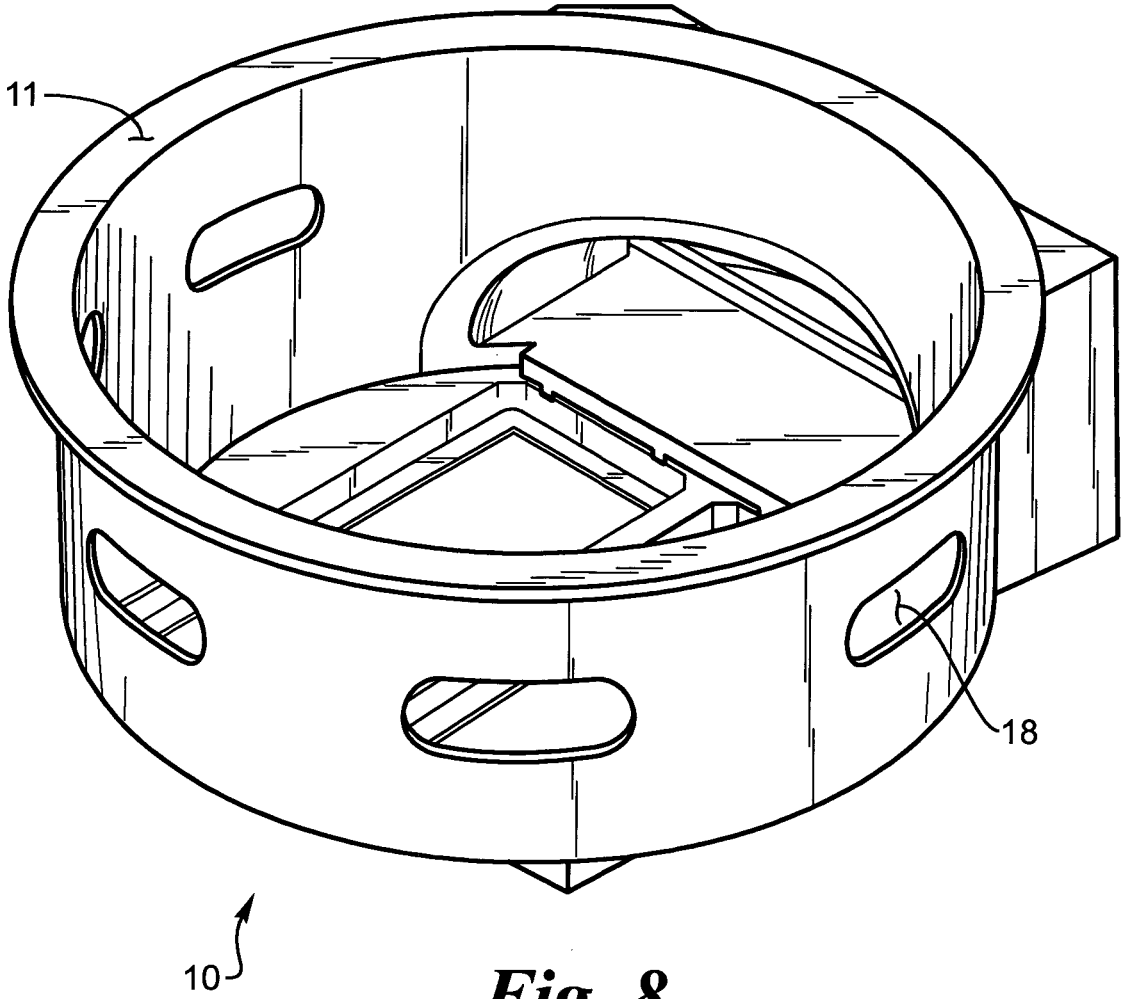
FIG. 8 is a perspective view of a manhole frame filter box.

In other embodiments the shapes of the curb inlet frame 50 may vary from rectangular to square or round and may be moved from adjacent to the curb to the middle of the street. The inlet frame 51 and baskets 40 and silt filter 30 will change shape accordingly as shown in FIG. 7 with a round manhole grate 61 on a round frame 62. The trap insert frame 10 would then be cylindrical having apertures 18 for overflow near the top. The slope at the top of the cylinder may not be needed if the manhole frame is not sloped. In this case the slope of the top of the walls of the box is zero.

The temporary trap 100 is preferably made out of a plastic material or other material, which is inexpensive and disposable.

Although a wire frame 31 or a suitable connection to the handles on the basket is used to support the cloth filter 32 any kind of a frame or support for the cloth filter 32 can be used to keep the cloth in a shape for use with the trap insert frame 10.

In the embodiments shown a gusset 70 is shown supporting curb box blocker 19 however this is an optional feature.

Although the specification above refers to catch basins, the invention can be used with storm, sanitary and catch basins.

Obviously, many modifications and variations of the present invention are possible in light of the above teachings. It is therefore to be understood that, within the scope of the appended claims, the invention may be practiced otherwise than as specifically described.

What is claimed is:

1. A catch basin curb inlet trap comprising, a trap insert frame having, a top, a bottom, a front side, a back side, a right side and a left side, the front side, right side, and left side having at least one aperture therein to let water pass therethrough and preventing debris from passing therethrough, a flange around the perimeter of the top of the trap insert frame for engaging a curb inlet frame and holding the box in place, at least one internal flange on the inside perimeter of the trap insert frame for supporting a basket having a corresponding flange at the top outside perimeter of the basket, the basket having a plurality of apertures for allowing water out while blocking debris from passing therethrough, the top portion of the trap insert frame having right and left side walls with a slope matching a curb inlet frame into which the trap insert frame is inserted, the front wall a different height than the rear wall.

2. A catch basin curb inlet trap as in claim 1 wherein, a curb box blocker extends up from the flange on the back wall to block water flow from entering the catch basin by entering a curb inlet box thereby bypassing the catch basin inlet trap.

3. A catch basin curb inlet trap as in claim 1 wherein, a filter is inserted into the basket to block smaller debris from entering the catch basin.

4. A catch basin curb inlet trap as in claim 1 wherein, three baskets to catch debris are used, a right side basket a left side basket and a center basket.

5. A catch basin curb inlet trap as in claim 4 wherein, three internal flanges on the inside perimeter of the trap are used wherein the center internal flange is set lower for channeling water and debris toward the center basket.

6. A catch basin curb inlet trap as in claim 1 wherein, the basket has a handle for ease of lifting the basket out of the trap insert frame.

7. A catch basin curb inlet trap as in claim 1 wherein, the trap insert frame has a curb box blocker extending upward from the back wall to block water from entering a curb box.

8. A catch basin curb inlet trap as in claim 7 wherein, a shelf extends between the back wall of the trap insert frame to the curb box blocker.

9. A catch basin curb inlet trap as in claim 8 wherein, an aperture in the self allows water to flow down behind the back wall of the trap insert frame.

10. A catch basin curb inlet trap as in claim 9 wherein, a gusset extends from the back wall of the trap insert frame to the shelf to help support the shelf and the curb box blocker.

11. A catch basin manhole trap comprising, a trap insert frame having, a circular top, a circular bottom, a cylindrical side wall with apertures therein to let water pass therethrough and preventing debris from passing therethrough, a flange around the circumference of the top of the trap insert frame for engaging a curb inlet frame and holding the box in place, a shelf extending between cylindrical walls having a flange for engaging a basket having a flange on the top, the cylinder wall having an overflow aperture at the top of the wall for allowing water and debris to exit the box if the apertures in the cylindrical wall and the bottom become clogged with debris or the water flow is too great for the apertures, the top portion of the trap insert frame between the flange and the cylinder wall having a slope matching a manhole frame into which the box is inserted.

12. A catch basin curb inlet trap as in claim 11 wherein, a filter is inserted into the basket to block smaller debris from entering the catch basin.

* * * * *